US009013373B2

(12) United States Patent
Takasugi et al.

(10) Patent No.: US 9,013,373 B2
(45) Date of Patent: Apr. 21, 2015

(54) IMAGE DISPLAY DEVICE

(75) Inventors: Shinji Takasugi, Yamato (JP); Kaoru Kusafuka, Kanagawa (JP)

(73) Assignee: LG Display Co., Ltd., Seoul (KR)

( * ) Notice: Subject to any disclaimer, the term of this patent is extended or adjusted under 35 U.S.C. 154(b) by 1670 days.

(21) Appl. No.: 11/892,558

(22) Filed: Aug. 23, 2007

(65) Prior Publication Data

US 2008/0088546 A1 Apr. 17, 2008

Related U.S. Application Data

(63) Continuation of application No. PCT/JP2006/301576, filed on Jan. 31, 2006.

(30) Foreign Application Priority Data

Feb. 25, 2005 (JP) ..... 2005-051137

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0847* (2013.01); *G09G 2300/0876* (2013.01); *G09G 2320/043* (2013.01)

(58) Field of Classification Search
USPC ..... 345/76–83
See application file for complete search history.

(56) References Cited

U.S. PATENT DOCUMENTS 6,229,506 B1 5/2001 Dawson et al.
6,590,227 B2 * 7/2003 Ishikawa ..... 257/68
6,753,834 B2 6/2004 Mikami et al.
7,355,571 B2 4/2008 Yamada et al.
7,446,740 B2 11/2008 Jung
7,564,433 B2 * 7/2009 Hector et al. ..... 345/82
2005/0057182 A1 3/2005 Shibusawa
2006/0244687 A1 11/2006 Fish et al.
2008/0088546 A1 * 4/2008 Takasugi et al. ..... 345/76

FOREIGN PATENT DOCUMENTS

JP 2002-072923 * 3/2002 ..... G09G 9/30
JP 2002-72923 A 3/2002
JP 2002-514320 A 5/2002

(Continued)

OTHER PUBLICATIONS

S. Ono et al., "Pixel Circuit for a-Si AM-OLED", AMD3/OEL4-2, IDW'03, pp. 225-258.

*Primary Examiner* — Jonathan Horner
*Assistant Examiner* — Douglas M Wilson
(74) *Attorney, Agent, or Firm* — Birch, Stewart, Kolasch & Birch, LLP

(57) ABSTRACT

An image display device comprises a light emitting element; a driver which has a control terminal, a first terminal and a second terminal, and which controls the current flowing between the first terminal and the second terminal by the voltage between the control terminal and the first terminal, to control the light emission of the light emitting element; a first capacitor having a first electrode and a second electrode, the first electrode being connected directly or indirectly to the control terminal of the driver, the second electrode being connected directly or indirectly to a signal line supplying the potential corresponding to an image data; and a second capacitor connected electrically in series to the first capacitor during a writing period while the image data is written to the first capacitor through the signal line.

8 Claims, 7 Drawing Sheets

(56) References Cited

FOREIGN PATENT DOCUMENTS

| | | | | |
|---|---|---|---|---|
| JP | 2002-297097 | A | | 10/2002 |
| JP | 2002-072923 | | * | 12/2002 |
| JP | 2004-341350 | A | | 12/2004 |
| JP | 2005-157283 | A | | 6/2005 |
| KR | 10-2001-0020114 | A | | 3/2001 |
| KR | 10-2005-0014849 | A | | 2/2005 |
| WO | WO-98/48403 | A1 | | 10/1998 |
| WO | WO-03/105117 | A2 | | 12/2003 |
| WO | WO 2004/088624 | A1 | | 10/2004 |

* cited by examiner

IMAGE DISPLAY DEVICE

CROSS-REFERENCE TO RELATED APPLICATIONS

The present application claims priority under 35 U.S.C. §120 to PCT Application No. PCT/JP2006/301576, filed on Jan. 31, 2006, entitled "IMAGE DISPLAY DEVICE". The contents of this application are incorporated herein by reference in their entirety.

TECHNICAL FIELD

The present invention relates to an image display device such as an organic EL display.

DESCRIPTION OF THE RELATED ART

Conventionally, an image display device with a current-control type organic EL (Electroluminescent) element which has a function of emitting light by recombination of positive holes and electrons injected into a light emitting layer has been proposed.

In such an image display device, a thin film transistor (TFT) which is formed from, for example, amorphous silicon or polycrystalline silicon, and the organic EL element constitute each pixel. The luminance is controlled through setting current of each pixel to appropriate value.

FIG. 13 is a diagram illustrating a structure of a pixel circuit corresponding to one pixel in a related image display device. In FIG. 13, the pixel circuit includes an organic EL element (OLED) as a lighting emitting element, an organic EL element capacitor (Coled), a driving transistor (Td) as a driving transistor, a threshold voltage detecting transistor (Tth), a storage capacitor (Cs) as a first capacitor, a first switching transistor (T1), and a second switching transistor (T2).

The driving transistor (Td) is a control element which serves to control an amount of current flowing through the organic EL element (OLED) according to voltage between a gate electrode (control electrode) and a source electrode (first electrode). The threshold voltage detecting transistor (Tth), when it is ON-state, electrically connects the gate electrode (control electrode) and a drain electrode (second electrode) of the driving transistor (Td), and the threshold voltage detecting transistor of ON-state causes current to flow from the gate electrode to the drain electrode of the driving transistor (Td) through the threshold voltage detecting transistor (Tth). When the current does not flow substantially, the voltage between the gate electrode and the source electrode of the driving transistor (Td) substantially reaches a threshold voltage (Vth) of the driving transistor (Td).

The organic EL element (OLED) has a characteristic that when a voltage, which is equal to or higher than a threshold voltage of the organic EL element (OLED), is applied to between an anode electrode and a cathode electrode, the current flows through the organic EL element (OLED), thereby the organic EL element (OLED) emits light. The organic EL element (OLED) has at least an anode layer and a cathode layer formed from Al, Cu, ITO (Indium Tin Oxide), or the like, and a light emitting layer formed from an organic material such as phthalocyanine, tris-aluminum complex, benzoquinolinolato, and beryllium complex, between the anode layer and the cathode layer. The organic EL element (OLED) emits light by recombining the positive hole and the electron injected to the light emitting layer. The organic EL element capacitor (Coled) represents capacitance of the organic EL element (OLED) equivalently.

The driving transistor (Td), the threshold voltage detecting transistor (Tth), the first switching transistor (T1), and the second switching transistor (T2) are, for example, thin film transistors. Though the drawings referred to below do not show channel type (n-type or p-type) of each thin film transistor, the thin film transistor is either n-type or p-type and should be interpreted in accordance with the description in this specification.

A power source line (10) supplies power to the driving transistor (Td) and the second switching transistor (T2). A Tth control line (11) supplies a signal for controlling the threshold voltage detecting transistor (Tth). A merge line (12) supplies a signal for controlling the second switching transistor (T2). A scan line (13) supplies a signal for controlling the first switching transistor (T1). An image signal line (14) supplies image signal.

In the above described construction, the pixel circuit operates through four periods, i.e., a preparation period, a threshold voltage detecting period, a writing period, and a light emission period. That is, during the preparation period, a positive potential of a predetermined level (Vp, Vp>0) is applied to the power source line (10), to control the threshold voltage detecting transistor Tth to be OFF, the first switching transistor (T1) to be OFF, the driving transistor (Td) to be ON, and the second switching transistor (T2) to be ON. As a result, the current flows from the power source line (10), through the driving transistor (Td), to the organic EL element capacitor (Coled), whereby the electric charges are accumulated in the organic EL element capacitor (Coled).

Next, during the threshold voltage detecting period, zero potential is applied to the power source line (10), to control the threshold voltage detecting transistor (Tth) to be ON, and to connect the gate electrode and the drain electrode of the driving transistor (Td). Thus, the electric charges accumulated in the storage capacitor (Cs) and the organic EL element capacitor (Coled) are discharged, thereby current flows from the driving transistor (Td) to the power source line (10). When the voltage between the gate electrode and the drain electrode of the driving transistor (Td) reaches the threshold voltage (Vth) corresponding to driving threshold of the driving transistor (Td), the driving transistor (Td) is turned OFF.

Next, during the writing period, the power source line (10) maintains zero potential, the first switching transistor (T1) is turned ON, and the second switching transistor (T2) is turned OFF, to discharge the electric charges accumulated in the organic EL element capacitor (Coled). As a result, the current flows from the organic EL element capacitor (Coled), through the threshold voltage detecting transistor (Tth), to the storage capacitor (Cs), whereby electric charges are accumulated in the storage capacitor (Cs). In other words, the electric charges accumulated in the organic EL element capacitor (Coled) moves to the storage capacitor (Cs).

Next, during the light emission period, a negative potential of a predetermined level ($-V_{DD}$, $V_{DD}>0$) is applied to the power source line (10), to control the driving transistor (Td) to be ON, the threshold voltage detecting transistor (Tth) to be OFF, and the first switching transistor (T1) to be OFF. As a result, the current flows from the organic EL element (OLED), through the driving transistor (Td), to the power source line (10), whereby the organic EL element (OLED) emits light.

As a Non-patent Publication of the related art, S. Ono et al., Proceedings of IDW, '03, 255 (2003) is published. The contents of this publication are incorporated herein by reference by in their entity.

The current (Ids) flowing through a driving TFT is known to be proportionate to the square of the difference between the threshold voltage (Vth) of the TFT and the voltage (Vgs) of the gate electrode to the source electrode (Vgs=Vg−Vs, where the Vg is the potential of the gate electrode, and the Vs is the potential of the source electrode). Therefore, the Vgs is required to be high enough to obtain bright images.

On the other hand, there is an index named "Vgs range" (=ΔVgs) which is represented as the voltage between the Vgs applied to the driving TFT when the luminance of emitting light is at the highest level and the Vgs applied to the driving TFT when the luminance is at the lowest level, or an index named "Writing efficiency" (=ΔVgs/ΔVdata) which is represented as the ratio between the Vgs range and the index named "the data voltage range" (ΔVdata) which is the difference between the potential applied to the pixel signal line when the luminance is at the highest level and the potential applied to the pixel signal line when the luminance is at the lowest level. As the data voltage range increases, the Vgs range can be increased. From a point of view which the driving IC is miniaturized and the facility of design is obtained, the high writing efficiency is needed.

Thus, it is required to increase the writing efficiency in order to achieve the facility of design in the above-described image display device.

However, the increase of the writing efficiency of the image display device is not easy. Especially, if the transistor of each pixel circuit has some parasitic capacitors, improvement of the writing efficiency decreased due to the parasitic capacitors is not easy.

FIG. 14 is a diagram illustrating a parasitic capacitor or the like generated in the pixel circuit shown in FIG. 13. In the conventional image display device as illustrated in FIG. 14, the driving transistor (Td) has a parasitic capacitor (CgdTd) and a parasitic capacitor (CgsTd) in the vicinity of the gate electrode thereof. The threshold voltage detecting transistor (Tth) has a parasitic capacitor (CgdTth) and a parasitic capacitor (CgsTth) in the vicinity of the gate electrode thereof.

The parasitic capacitors are known to be a main cause of decrease in writing efficiency of the organic EL element (OLED). Hence, a method to effectively minimize the negative effect of the parasitic capacitors is highly required.

SUMMARY

According to an aspect of the invention, a first image display device comprises a light emitting element; a driver which has a control terminal, a first terminal and a second terminal, and which controls the electric current flowing between the first terminal and the second terminal by the voltage between the control terminal and the first terminal, to control the light emission of the light emitting element. The first image display device also comprises a first capacitor having a first electrode and a second electrode. The first electrode is connected directly or indirectly to the control terminal of the driver and the second electrode is connected directly or indirectly to a signal line supplying the potential corresponding to an image data. The first image display device further comprises a second capacitor element connected electrically in series to the first capacitor element during a writing period when the image data is written to the first capacitor element through the signal line.

According to another aspect of the invention, a second image display device comprises a light emitting element; a driver which has a control terminal, a first terminal and a second terminal, and which controls the amount of current flowing between the first terminal and the second terminal by the voltage between the control terminal and the first terminal to control the light emission of the light emitting element. The second image display device also comprises a signal line supplying the writing potential to generate a voltage applied to either between the control terminal and the first terminal of the driver, or between the control terminal and the second terminal of the driver. The second image display device further comprises a capacitor enlarging the ratio (ΔVgs/ΔVdata) of the voltage range (ΔVgs) to the voltage range (ΔVdata). The voltage range (ΔVgs) is the voltage difference between the voltage applied to the driver when the luminance of the light emitting element is at the highest level and the voltage when the luminance of the light emitting element is at the lowest level. The voltage range (ΔVdata) is the voltage difference between the writing voltage applied to the signal line when the luminance of the light emitting element is at the highest level and the writing voltage when the luminance of the light emitting element is at the lowest level.

DETAILED DESCRIPTION OF THE PREFERRED EMBODIMENT

In the following, exemplary embodiments of an image display device according to the present invention will be described in detail with reference to the accompanying drawings. It should be noted that the present invention is not limited to the embodiments described below.

First Embodiment

Figure 1:
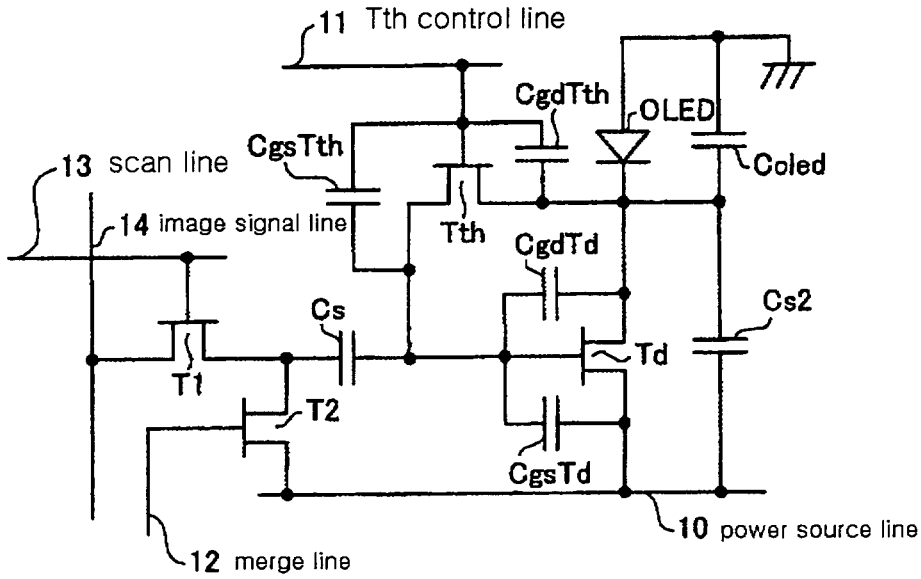
FIG. 1 is a diagram illustrating a structure of a pixel circuit corresponding to one pixel in an image display device according to a first embodiment of the present invention.
Figure 14:
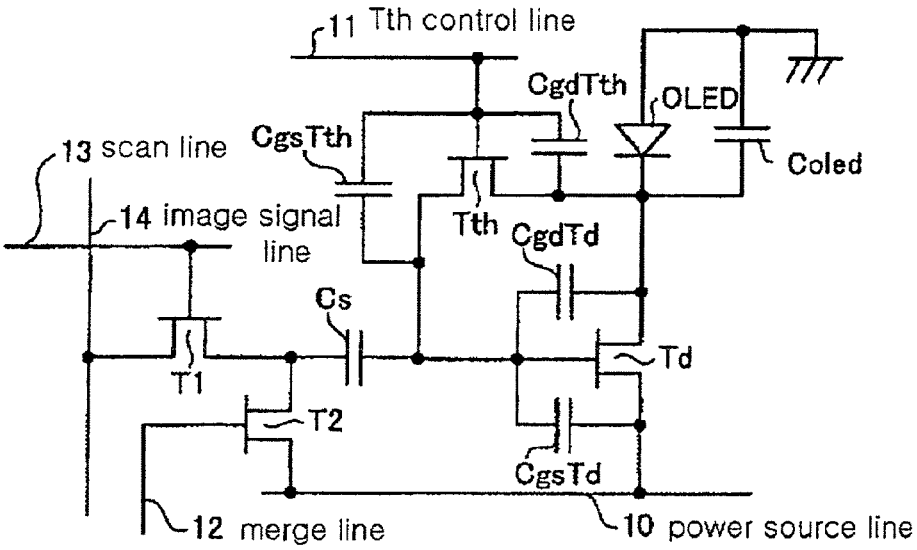
FIG.14 Prior Art
FIG. 14 is a diagram illustrating a parasitic capacitance or the like generated in the pixel circuit illustrated in FIG. 13.

FIG. 1 is a diagram illustrating a structure of a pixel circuit corresponding to one pixel in an image display device according to a first embodiment of the present invention. In FIG. 1, elements corresponding to those illustrated in FIG. 14 are denoted by the same reference characters. A pixel circuit illustrated in FIG. 1 further includes an additional capacitor (Cs2) as a second capacitor.

The additional capacitor (Cs2) is the capacitor which serves to prevent or improve decrease of the writing efficiency due to the parasitic capacitor or the like. For example, the additional capacitor (Cs2) is connected to the cathode electrode of the organic EL element (OLED) (and/or the drain electrode of the driving transistor (Td)) at one side, and to the power source line (10) (and/or the source electrode of the driving transistor (Td)) at the other side.

Next, an operation of the first embodiment will be described with reference to FIG. 2. Herein below, the operation during four periods, i.e., the preparation period, the threshold voltage detecting period, the writing period, and the light emission period, will be described. The operation described below is controlled by a controller (not shown).

(Preparation Period)

Figure 2:
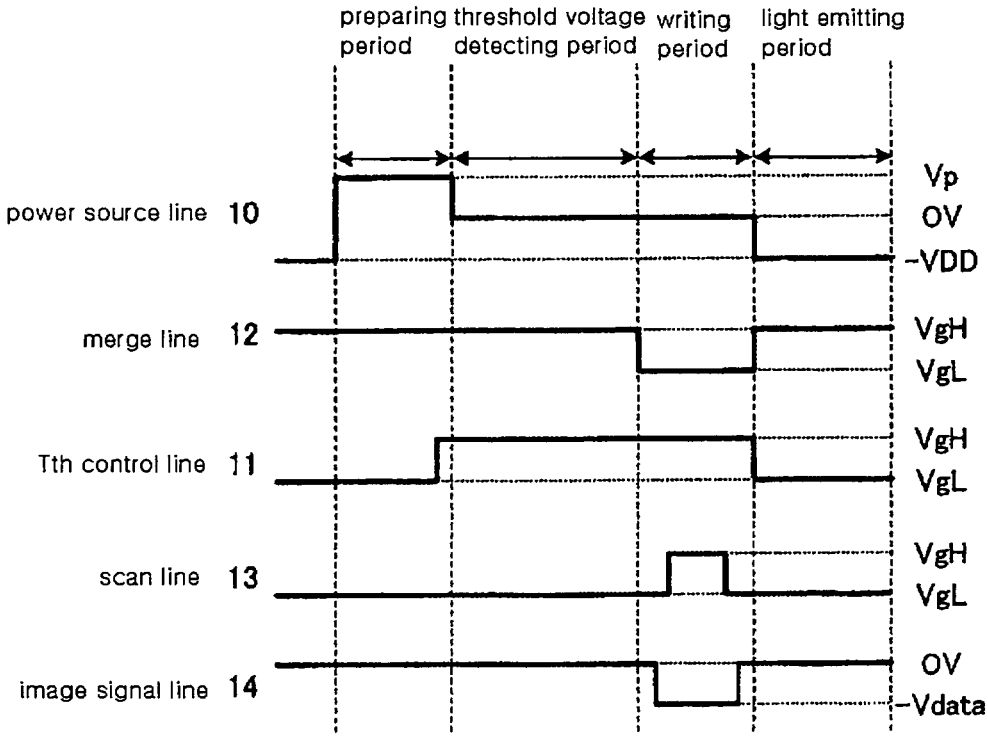
FIG. 2 is a sequence diagram illustrating an operation according to the first embodiment.
Figure 3:
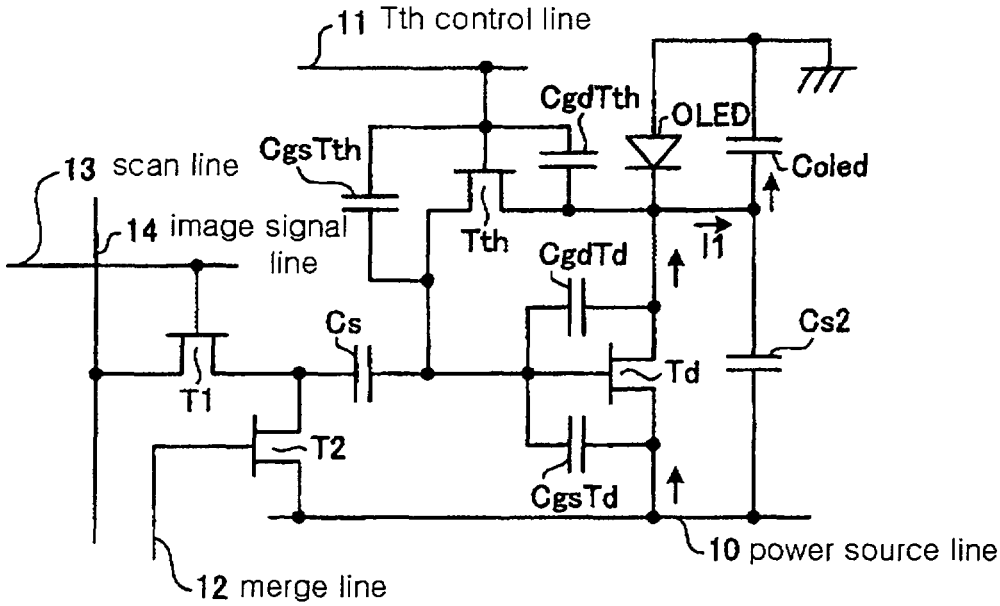
FIG. 3 is an explanatory diagram illustrating an operation during a preparation period illustrated in FIG. 2.

In the preparation period illustrated in FIG. 2, a potential of the power source line (10) is set to a high potential (Vp), a potential of the merge line (12) is set to a high potential (VgH), a potential of the Tth control line (11) is set to a low potential (VgL), a potential of the scan line (13) is set to a low potential (VgL), and a potential of the image signal line (14) is set to zero potential. Hence, as illustrated in FIG. 3, the threshold voltage detecting transistor (Tth) is turned OFF, the first switching transistor (T1) is turned OFF, the driving transistor (Td) is turned ON, and the second switching transistor (T2) is turned ON. As a result, the current (11) flows sequentially from the power source line (10), through the driving transistor (Td), to the organic EL element capacitor (Coled), whereby the electric charges are accumulated in the organic EL element capacitor (Coled). The electric charges are accumulated in the organic EL element during the preparation period, because the current is supplied up until Ids substantially attains zero in the threshold voltage detection.

(Threshold Voltage Detecting Period)

Figure 4:
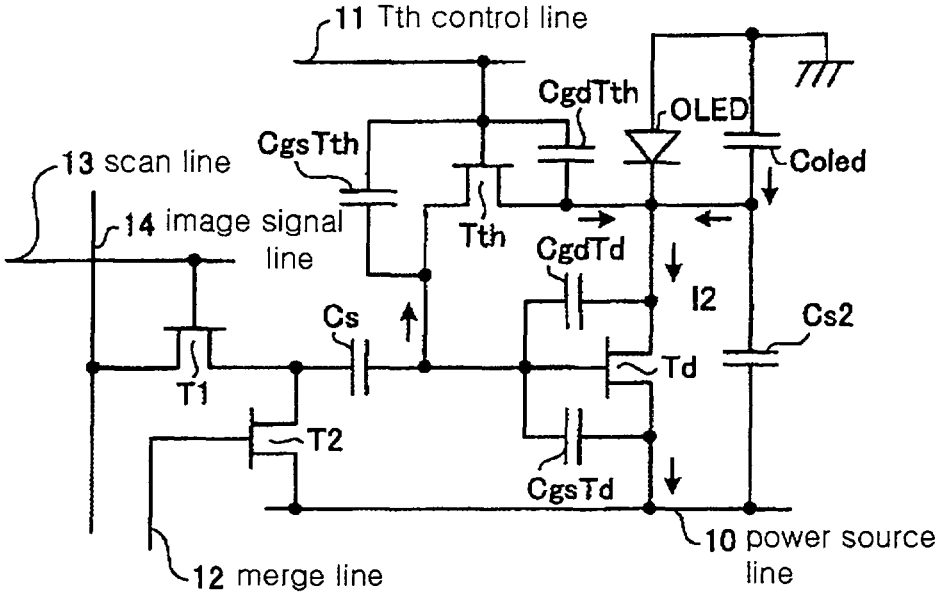
FIG. 4 is an explanatory diagram illustrating an operation during a threshold voltage detecting period illustrated in FIG. 2.

Next, during the threshold voltage detecting period, a potential of the power source line (10) is set to zero potential, a potential of the merge line (12) is set to a high potential (VgH), a potential of the Tth control line (11) is set to a high potential (VgH), a potential of the scan line (13) is set to a low potential (VgL), and a potential of the image signal line (14) is set to zero potential. Thus, as illustrated in FIG. 4, the threshold voltage detecting transistor (Tth) is turned ON, and the gate electrode and the drain electrode of the driving transistor (Td) are connected.

Further, the electric charges accumulated in the storage capacitor (Cs) and the organic EL element capacitor (Coled) are discharged, then a current (12) flows from the driving transistor (Td) to the power source line (10). When the voltage (Vgs) between the gate electrode and the source electrode of the driving transistor (Td) substantially reaches the threshold voltage (Vth), the driving transistor (Td) is turned OFF and the threshold voltage (Vth) of the driving transistor (Td) is detected.

(Writing Period)

Next, during the writing period, the potential of the gate electrode of the driving transistor (Td) is changed to a desired potential by supplying a data potential (−Vdata) from the image signal line to the storage capacitor (Cs) directly or indirectly. Specifically, a potential of the power source line (10) is set to zero potential, a potential of the merge line (12) is set to a low potential (VgL), a potential of the Tth control line (11) is set to a high potential (VgH), a potential of the scan line (13) is set to a high potential (VgH), and a potential of the image signal line (14) is set to a data potential (−Vdata). At this time, the storage capacitor (Cs) and the organic EL element capacitor (Coled) are connected electrically in series, and the additional capacitor (Cs2) and the organic EL element capacitor (Coled) are connected electrically in parallel.

Figure 5:
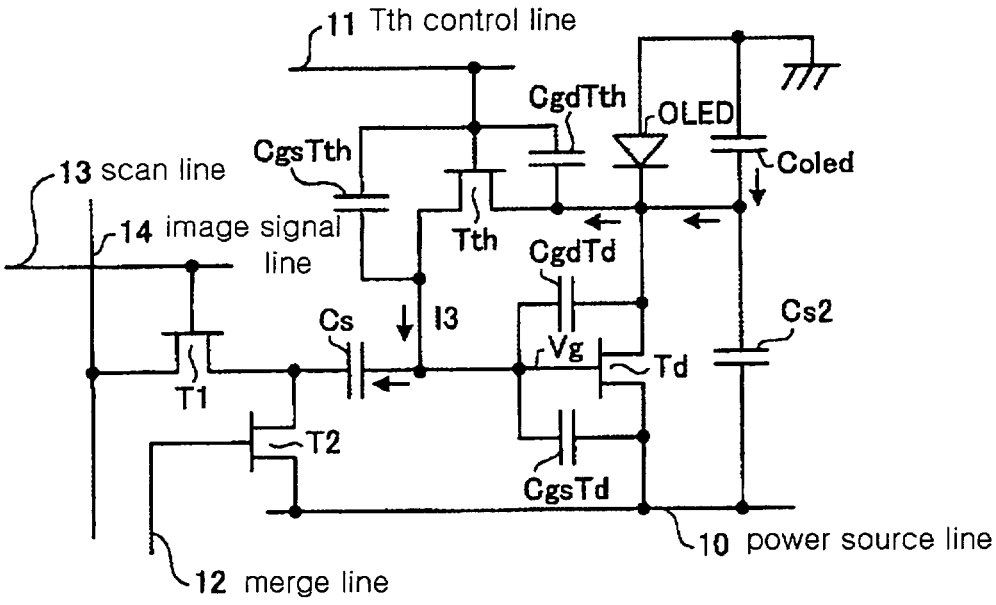
FIG. 5 is an explanatory diagram illustrating an operation during a writing period illustrated in FIG. 2.

Then, as illustrated in FIG. 5, the first switching transistor (T1) is turned ON, and the second switching transistor (T2) is turned OFF. Thus, the electric charges accumulated in the organic EL element capacitor (Coled) are discharged. As a result, a current (13) flows from the organic EL element capacitor (Coled), through the threshold voltage detecting transistor (Tth), to the storage capacitor (Cs), whereby the electric charges are accumulated in the storage capacitor (Cs). In other words, the electric charges accumulated in the organic EL element capacitor (Coled) move to the storage capacitor (Cs).

Here, provided that the additional capacitor (Cs2) does not exist, the Vgs of the driving transistor (Td) during the writing period can be represented by the following equation (1). Note that the above assumption applies also to the following equations (2) to (7).

$$Vgs = Vth - (Cs/\mathrm{Call}) \cdot V\mathrm{data} \quad (1)$$

In the equation (1), 'Call' represents the entire capacitance connected directly to the gate electrode of the driving transistor (Td) when the threshold voltage detecting transistor (Tth) is ON, and can be represented by the following equation.

$$\mathrm{Call} = \mathrm{Coled} + Cs + CgsTth + CgdTth + CgsTd \quad (2)$$

In the equation (2), 'Coled' is an equivalent capacitance of the organic EL element (OLED), 'CgsTth' is an parasitic capacitance between the gate electrode and the source electrode of the threshold voltage detecting transistor (Tth), 'CgdTth' is an parasitic capacitance between the gate electrode and the drain electrode of the threshold voltage detecting transistor (Tth), and 'CgsTd' is an parasitic capacitance between the gate electrode and the source electrode of the driving transistor (Td).

Also, during the writing period, the threshold voltage detecting transistor (Tth) is turned on, and the gate electrode and the drain electrode of the driving transistor (Td) are connected, and both the gate and drain electrodes are substantially the same potential. Therefore, the parasitic capacitance (CgdTd) does not have any influence on the Call in equation (2). In addition, it is preferable that the relation between the storage capacitor (Cs) and the organic EL element capacitor (Coled) be set to be Cs<Coled.

(Light Emission Period)

Next, during the light emission period, a potential of the power source line (10) is set to a minus potential ($-V_{DD}$), a potential of the merge line (12) is set to a high potential (VgH), a potential of the Tth control line (11) is set to a low potential (VgL), a potential of the scan line (13) is set to a low potential (VgL), and a potential of the image signal line (14) is set to zero potential.

Figure 6:
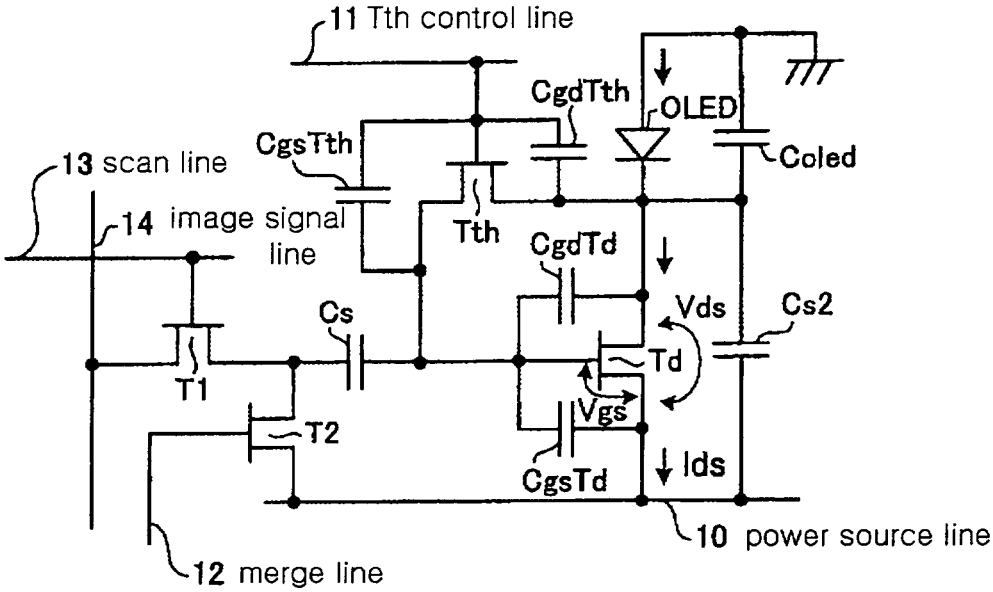
FIG. 6 is an explanatory diagram illustrating an operation during a light emission period illustrated in FIG. 2.

Then, as illustrated in FIG. 6, the driving transistor (Td) is turned ON, the threshold voltage detecting transistor (Tth) is turned OFF, and the first switching transistor (T1) is turned OFF. As a result, a current (Ids) flows from the organic EL element (OLED), through the driving transistor (Td), to the power source line (10), whereby the organic EL element (OLED) emits light.

Here, Vgs' represents the voltage between the gate electrode and the source electrode of the driving transistor (Td) during the light emission period, and Vgs represents the voltage between the gate electrode and the source electrode of the driving transistor (Td) obtained from the equation (1) during the writing period. the conservation of charge represented by equation (4) stands by using the entire capacitance during the writing period represented in the equation (2) (Call) (Call is the entire capacitance when the threshold voltage detecting transistor (Tth) is ON) and the entire capacitance during the light emission period represented by the following equation (3) (Call') (Call' is the entire capacitance when the threshold voltage detecting transistor (Tth) is OFF)

$$Call'=Cs+CgsTth+CgsTd+CgdTd \tag{3}$$

$$Cs\cdot(Vgs+V\text{data})+CgsTth(Vgs-VgH)+CgsTd\cdot Vgs=(Cs+CgsTd)\cdot Vgs'+CgsTth\cdot(Vgs'-VgL)+CgdTd\cdot(Vgs'-Vds) \tag{4}$$

In the equation (4), terms of Coled and CgdTh in the equation (2) do not exist because the threshold voltage detecting transistor (Tth) is OFF during the light emission period and the electric charges accumulated in the organic EL element capacitor (Coled) and in the parasitic capacitor (CgdTh) of the threshold voltage detecting transistor do not move during the writing period.

The voltage (Vgs') between the gate electrode and the source electrode of the driving transistor (Td) during the light emission period is represented by the following equation (5), using the relation of the equation (4).

$$Vgs'=((Cs+CgsTth+CgsTd)\cdot(Vth-(Cs/\text{Call})\cdot V\text{data})+Cs\cdot V\text{data}+CgsTth\cdot(VgL-VgH)+CgdTd\cdot Vds)/\text{Call}' \tag{5}$$

Here, η stands for writing efficiency (ΔVgs/ΔVdata) which is the ratio of the actual Vgs range (ΔVgs) to the data voltage range (ΔVdata). If the change of Vgs' is almost linear to the Vdata, the η is represented by the following equation (6.1).

$$\eta=\Delta Vgs/\Delta V\text{data}\approx\partial Vgs'/\partial V\text{data} \tag{6.1}$$

For assumption, the value of Vgs" here can be represented by the following equation (6.2)

$$Vgs''=Vgs'+(CgdTd/\text{Call}')Vds \tag{6.2}$$

When the right side of equation (5) is substituted for Vgs' of equation (6.2), Vgs" becomes the value of the following equation (6.3) and the term of Vds depending on Vdata vanishes.

$$Vgs''=((Cs+CgsTth+CgsTd)\cdot(Vth-(Cs/\text{Call})\cdot V\text{data})+Cs\cdot V\text{data}-CgsTth\cdot VgH-CgsTth\cdot VgL)/\text{Call}' \tag{6.3}$$

Further, the value of ζ here can be represented by the following equation (6.4).

$$\zeta=\partial Vgs''/\partial V\text{data} \tag{6.4}$$

The ζ can be represented by equation (6.5).

$$\partial=Cs\cdot(\text{Coled}+CgdTth)/(\text{Call}\cdot\text{Call}') \tag{6.5}$$

Also, the equation (6.1) can be modified to the following equation (7).

$$\begin{aligned}\eta &= \partial Vgs'/\partial Vdata \\ &= (\partial Vgs'/\partial Vgs'')\cdot(\partial Vgs''/\partial Vdata) \\ &= \zeta/(\partial Vgs''/\partial Vgs')\end{aligned} \tag{7}$$

Here, ∂Vgs"/∂Vgs' can be approximated like the following by referring to the equation (6.2).

$$1+(CgdTd/\text{Call}')\cdot(\partial Vds/\partial Vgs')\approx 1.$$

Thus, η approximates to ζ(i.e., η≈ζ), and η can be represented by the following equation (8).

$$\eta\approx Cs\cdot(\text{Coled}+CgdTth)/(\text{Call}\cdot\text{Call}') \tag{8}$$

Thus, the equation (8) represents the writing efficiency.

It is preferable that the writing efficiency is large, when the strength voltage of the driving IC and the control range of the potential of the image signal line are taken into consideration. However, it is clear from the equation (8) that the writing efficiency can not be sufficiently enlarged due to the parasitic capacitor, in this circuit which uses the organic EL element (OLED) as a capacitor.

Thus, in this embodiment, the additional capacitor (Cs2) is provided to solve the above problem. Hereinafter, the function of the additional capacitor (Cs2) that improves the writing efficiency under the existence of the parasitic capacitor will be described in detail.

First, the voltage (Vgs) between the gate electrode and the source electrode of the driving transistor (Td) during the writing period under the existence of the additional capacitor (Cs2) can be represented by the following equation (9).

$$Vgs=Vth-(Cs/(\text{Call}+\text{Cs2}))\cdot V\text{data} \tag{9}$$

Thus, the voltage (Vgs') between the gate electrode and the source electrode of the driving transistor (Td) during the light emission period under the existence of the additional capacitor (Cs2) can be represented by the following equation (10), by substituting the equation (9) for the equation (4).

$$Vgs'=Cs\cdot(\text{Coled}+CgdTth+Cs2)/((\text{Call}+\text{Cs2})\cdot\text{Call}')\cdot V\text{data}+((Cs+CgsTth+CgsTd)\cdot Vth+CgsTth\cdot(VDD+VgL-VgH)+CgdTd\cdot Vds)/\text{Call}' \tag{10}$$

Thus, the writing efficiency (η') under the existence of the additional capacitor (Cs2) can be represented by the following equation (11).

$$\eta'=Cs\cdot(\text{Coled}+CgdTth+Cs2)/((\text{Call}+Cs2)\cdot\text{Call}') \tag{11}$$

From the equations (8) and (11), η'/η can be calculated as below.

$$\begin{aligned}\eta'/\eta &= [(Coled+CgdTth+Cs2)/(\text{Call}+Cs2)]/[(Coled+CgdTth)/\text{Call}] \\ &= [(Coled+CgdTth+Cs2)/(Coled+CgdTth)]/[(\text{Call}+Cs2)/\text{Call}] \\ &= [1+Cs2/(Coled+CgdTth)]/(1+Cs2/\text{Call})\end{aligned} \tag{12}$$

In the equation (12), there is a relationship that Call is larger than the sum of Coled and CgdTth (i.e., Call>Coled+CgdTth), and η'/η is always equal to or higher than 1. This shows that the writing efficiency is improved by providing the additional capacitor (Cs2). The larger the additional capacitor (Cs2) becomes, the higher the writing efficiency becomes. Therefore, it is preferable that a capacitance value of the additional capacitor (Cs2) is equal to or higher than 10% of the capacitance value of Coled (more preferably, equal to or higher than 30% of the capacitance value of Coled).

The writing efficiency of an actual pixel circuit can be calculated as below. For example, when Coled is set to 0.32 pF, Cs is set to 0.15 pF, Cs2 is set to 0.2 pF, CgdTth and CgsTth are set to 0.01 pF, and CgdTd and CgsTd are set to 0.03 pF for typical values, the writing efficiency (η) under the absence of the additional capacitor (Cs2) is 0.433 from the equation (2), (3) and (8).

On the other hand, the writing efficiency (η') under the existence of the additional capacitor (Cs2) is 0.502 from the equation (2), (3) and (11).

In this example, the ratio ($\Delta\eta/\eta$) of the differential value ($\Delta\eta$) of the writing efficiency between $\eta'$ and $\eta$ to the writing efficiency ($\eta$) under the absence of the additional capacitor (Cs2) is (0.502−0.433)/0.433≈0.16. Thus, the writing efficiency is improved about 16% by providing the additional capacitor (Cs2). Also, if the additional capacitor (Cs2) with the largest value as possible is used, the writing efficiency can be improved even more.

Generally, the capacitances of the organic EL element (OLED) in each pixel of red, green and blue are different. Thus, when Coledr, Coledg and Coledb respectively represent the capacitance of each organic EL element (OLED) of red, green and blue, and Cs2r, Cs2g and Cs2b respectively represent the additional capacitance of red, green and blue, it is preferable that the values of Coledr+Cs2r, Coledg+Cs2g and Coledb+Cs2b are set to 80%~100% of the maximum value among these values (more preferably, 95%~100%) to make the writing efficiencies be substantially the same.

Also, when the differences exist in the characteristic light emitting efficiency of each color, the desired Vgs range ($\Delta$Vgs) in each pixel circuit can be different.

Now, the writing efficiency of each color is represented as below:

$$\eta r=(\mathrm{Coled}r+Cs2r+CgdTth)/(\mathrm{Coled}r+Cs2r+Cs+CgsTth+CgdTth+CgsTd)$$

$$\eta g=(\mathrm{Coled}g+Cs2g+CgdTth)/(\mathrm{Coled}g+Cs2g+Cs+CgsTth+CgdTth+CgsTd)$$

$$\eta b=(\mathrm{Coled}b+Cs2b+CgdTth)/(\mathrm{Coled}b+Cs2b+Cs+CgsTth+CgdTth+CgsTd)$$

and $\Delta$Vgsmaxr, $\Delta$Vgsmaxg and $\Delta$Vgsmaxb represent the maximum values of the $\Delta$Vgs required in each color.

Here, when Cs2r, Cs2g and Cs2b is set to cause the minimum value of $\Delta$Vgsmaxr/$\eta$r, $\Delta$Vgsmaxg/$\eta$g and $\Delta$Vgsmaxb/$\eta$b to be equal to or higher than 90% of the maximum value of $\Delta$Vgsmaxr/$\eta$r, $\Delta$Vgsmaxg/$\eta$g and $\Delta$Vgsmaxb/$\eta$b, the desired Vgs range ($\Delta$Vgs) in every color with substantially the same data voltage range ($\Delta$Vdata) can be obtained.

As described above, since the image display device according to the first embodiment includes the additional capacitor (Cs2) as mentioned above, the influence of the parasitic capacitance which is present in the driving transistor (Td) (driver), the threshold voltage detecting transistor (Tth) (threshold voltage detecting element) or the like can be reduced. Thus, the writing efficiency due to the parasitic capacitance can be increased.

Further, in the first embodiment, though amorphous silicon TFT or polycrystalline TFT is used for the threshold voltage detecting element and the driver, poly-silicon TFT or other types of TFT may be employed instead.

Second Embodiment

In the first embodiment illustrated in FIG. 1, though the additional capacitor (Cs2) is connected to the cathode electrode of the organic EL element (OLED) at one side, and to the power source line (10) at the other side, the present invention is not limited to this construction. For example, the additional capacitor (Cs2) can be connected to the Tth control line (11) at the other side. Also, it can be connected to the ground line with static potential (constant potential) or the like, besides the Tth control line (11).

Further, the static potential does not need to be the constant potential during all periods, i.e., the preparation period, the threshold voltage detecting period, the writing period, and the light emission period. It is sufficient to maintain the constant potential at least during writing period.

Also, the constant potential does not have to be constant in the strict sense, and within the range in which the writing efficiency can be improved due to the additional capacitor (Cs2), the fluctuation of the potential may be allowed.

Figure 7:
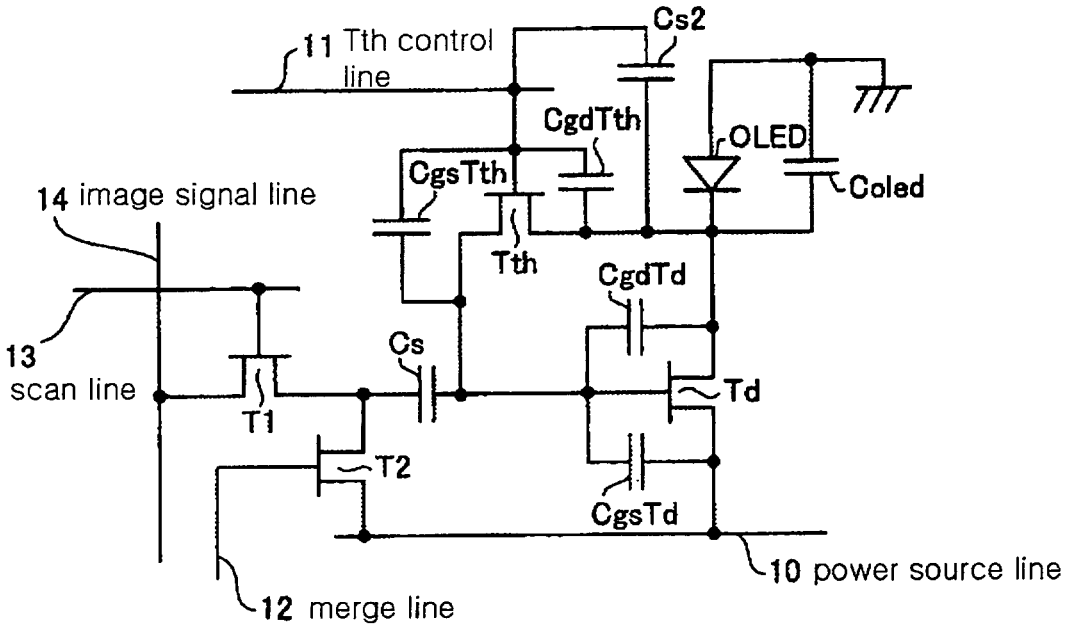
FIG. 7 is a diagram illustrating a structure of a pixel circuit corresponding to one pixel in an image display device according to a second embodiment of the present invention.

FIG. 7 is a diagram illustrating an exemplary structure according to the second embodiment of the present invention and describes that an additional capacitor (Cs2) is connected to the Tth control line (11) controlling the threshold voltage detecting transistor (Tth).

Further, in the first embodiment, the exemplary structure that the additional capacitor (Cs2) is applied to the pixel circuit of the structure illustrated in FIG. 1 is described. However, a pixel circuit with any connection structure may be employable as far as the pixel circuit has the driving transistor and the threshold voltage detecting transistor. The point is to connect the additional capacitor (Cs2) which satisfies the requirements described in the first embodiment to the gate electrode of the driving transistor.

Third Embodiment

Figure 8:
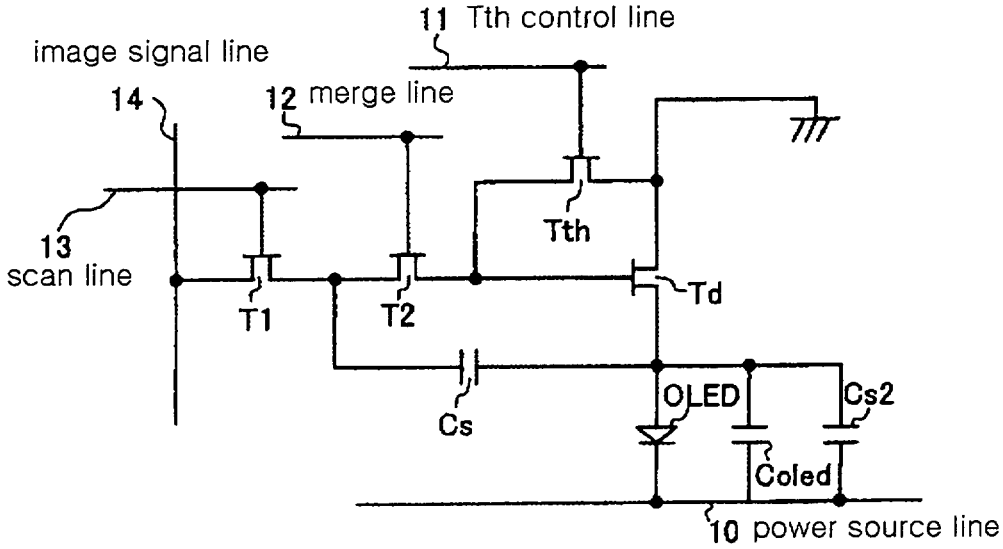
FIG. 8 is a diagram illustrating a structure of a pixel circuit corresponding to one pixel in an image display device according to a third embodiment of the present invention.

FIG. 8 is a diagram illustrating a structure of a pixel circuit corresponding to one pixel in an image display device according to a third embodiment of the present invention. The construction of the pixel circuit illustrated in FIG. 8 is different from that of the pixel circuit illustrated in FIG. 1. Specifically, the cathode electrode of the organic EL element (OLED) is connected to the power source line (10), and the anode electrode is connected to the source electrode of the driving transistor (Td). Also, the drain electrode of the driving transistor (Td) is connected to the ground line. The gate electrode is connected to the connecting part of the switching transistors (T1, T2) and connected indirectly to the image signal line (14) through the first switching transistor (T1). The gate electrode of the first switching transistor (T1) is connected to the scan line (13). The gate electrode of the second switching transistor (T2) is connected to the merge line (12). The threshold voltage detecting transistor (Tth) is interposed between the gate electrode and the drain electrode of the driving transistor (Td), and the Tth control line (11) is connected to the gate electrode of the threshold voltage detecting transistor. The storage capacitor (Cs) is interposed between the connecting part of the switching transistors (T1, T2) and the anode electrode of the organic EL element (OLED). The additional capacitor (Cs2) used in the above mentioned embodiment is interposed between the storage capacitor (Cs) and the power source line (10) to connect itself with the storage capacitor (Cs) in series during the writing period of the image signal potential described below.

Further, in the above description, the structure is described that the source electrode of the driving transistor (Td) is connected to the anode electrode of the organic EL element (OLED) and the drain electrode thereof is connected to the ground line. However, it can be applied to the structure where the source and drain electrodes are exchanged to the contrary.

Next, an operation of the third embodiment will be described with reference to FIG. 9. As in the first embodiment, the operation during four periods, i.e., the preparation period, the threshold voltage detecting period, the writing period, and the light emission period, will be described.

(Preparation Period)

First, during the preparation period, a potential of the power source line (10) is set to a high potential (Vp), a potential of the merge line (12) is set to a high potential (VgH), a potential of the Tth control line (11) is set to a low potential (VgL), a potential of the scan line (13) is set to a low potential (VgL), and a potential of the image signal line (14) is set to zero potential. Hence, the threshold voltage detecting transistor (Tth) is turned OFF, the first switching transistor (T1) is turned OFF, the driving transistor (Td) is turned ON, and the second switching transistor (T2) is turned ON. The reason why the driving transistor is turned ON is that the second switching transistor (T2) maintains its ON-state from the light emission period, and that the supply of the electric charges from the storage capacitor (Cs) to the gate electrode of the driving transistor (Td) is maintained. As a result, the voltage applied between the gate electrode of the driving transistor (Td) and the drain electrode is larger than the threshold voltage of the driving transistor (Td), and the potential of the source electrode is higher than that of the drain electrode, thus the driving transistor (Td) maintains its on-state. Here, the current flows sequentially from the power source line (10), through the organic EL element capacitor (Coled) (and additional capacitor (Cs2)), to the driving transistor (Td), whereby the electric charges are accumulated in the organic EL element capacitor (Coled) and the additional capacitor (Cs2). The reason why the electric charges are accumulated in the organic EL element (OLED) or the additional capacitor (Cs2) is that the current is supplied up until Ids substantially attains zero at the threshold voltage detection of the driving transistor (Td), in the same manner as the first embodiment.

Figure 9:
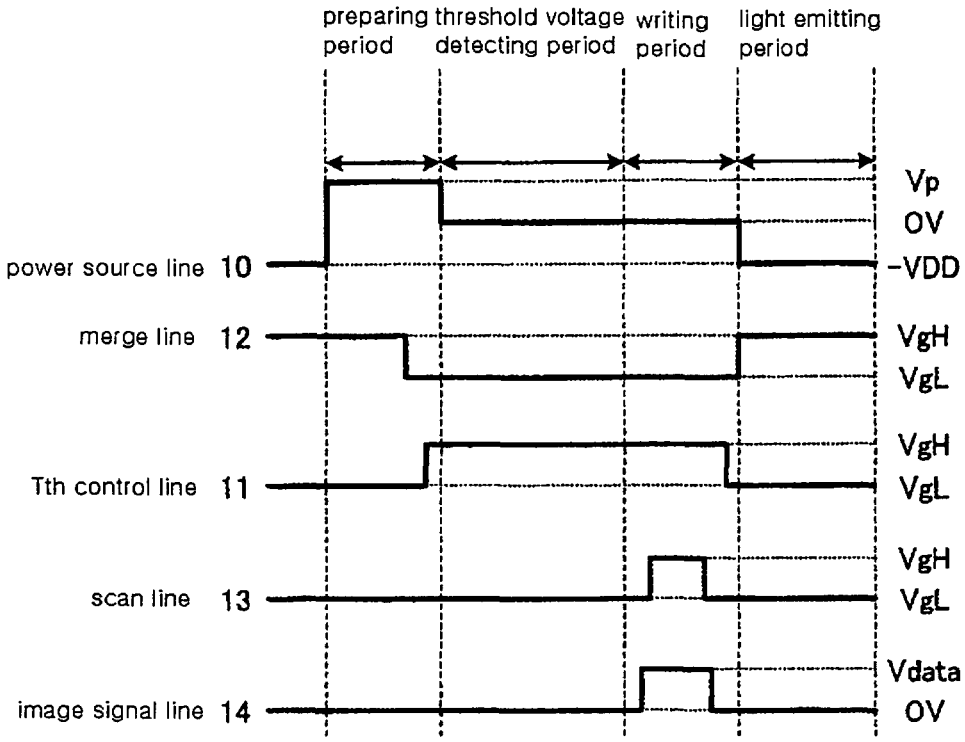
FIG. 9 is a sequence diagram illustrating an operation according to the third embodiment.

Further, as illustrated in FIG. 9, when proceeding from the preparation period to the threshold voltage detecting period, the potential of the merge line (12) is set to the low potential (VgL) to turn the second switching transistor (T2) OFF, and then the potential of the Tth control line (11) is set to the high potential (VgH) to turn the threshold voltage detecting transistor (Tth) ON. This reason is that the organic EL element capacitor (Coled) retains electric charges accumulated therein.

(Threshold Voltage Detecting Period)

Next, during the threshold voltage detecting period, it is maintained that a potential of the power source line (10) is set to zero potential, a potential of the merge line (12) is set to a low potential (VgL), a potential of the Tth control line (11) is set to a high potential (VgH), a potential of the scan line (13) is set to a low potential (VgL), and a potential of the image signal line (14) is set to zero potential. Thus, the threshold voltage detecting transistor (Tth) maintains its on-state, thereby connecting the gate electrode and the drain electrode of the driving transistor (Td) through the threshold voltage detecting transistor (Tth) and connecting the gate electrode to the ground line through the drain electrode. As a result, the zero potential is applied to the gate electrode and the drain electrode of the driving transistor (Td). In this case, since the organic EL element (OLED) is connected to the source electrode of the driving transistor (Td), the negative electric charges accumulated in the anode electrode of the organic EL element (OLED) causes the voltage between the gate electrode and the source electrode of the driving transistor (Td) to be larger than the threshold voltage (Vth) of the driving transistor (Td). Thus, the driving transistor (Td) is turned ON.

The drain electrode of the driving transistor (Td) is electrically connected to the ground line, and the source electrode of the driving transistor (Td) is connected to the organic EL element (OLED) in which the negative electric charges are accumulated. As a result, the current flows from the drain electrode to the source electrode of the driving transistor (Td) due to the voltage between the gate electrode and the source electrode. As a result of flowing of the current, the absolute value of the negative electric charges accumulated in the organic EL element (OLED) slowly decreases and the voltage between the gate electrode and the source electrode of the driving transistor slowly decreases too. When the voltage between the gate electrode and the source electrode of the driving transistor (Td) is decreased to the threshold voltage (Vth), the driving transistor (Td) is turned OFF, and the decrease of the absolute value of the negative electric charges accumulated in the organic EL element (OLED) stops. Further, when the driving transistor (Td) is turned OFF, the potential of the source electrode of the driving transistor (Td) is maintained to the (−Vth), because the gate electrode of the driving transistor (Td) is connected to the ground line. From this function, the threshold voltage (Vth) of the driving transistor (Td) is detected.

(Writing Period)

Next, during the writing period, the potential of the gate electrode of the driving transistor (Td) is controlled and changed to a desired potential by supplying a data potential (Vdata) from the image signal line (14) to the storage capacitor (Cs) directly or indirectly. Specifically, while a potential of the power source line (10) is maintained to zero potential, a potential of the merge line (12) is maintained to a low potential (VgL), and a potential of the Tth control line (11) is maintained to a high potential (VgH), a potential of the scan line (13) is set to a high potential (VgH), and a potential of the image signal line (14) is set to a data potential (Vdata). At this time, the storage capacitor (Cs) and the organic EL element capacitor (Coled) are connected electrically in series, and the additional capacitor (Cs2) and the organic EL element capacitor (Coled) are connected electrically in parallel.

The image signal line (14) is changed from the state with zero potential to the state with the potential (Vdata) corresponding to the luminance of the organic EL element (OLED), to supply the potential (Vdata). The potential (Vdata) is written to the storage capacitor (Cs) through the first switching transistor (T1) controlled to the on-state by setting the scan line (13) being the high potential (VgH), and is maintained through the first switching transistor (T1) controlled to the off-state by setting the scan line (13) being the low potential (VgL). Further, as illustrated in FIG. 9, a potential of the Tth control line (11) is maintained to a high potential (VgH), but it is preferable that a potential of the Tth control line (11) is set to a low potential (VgL), to prepare a potential of the merge line (12) which is set to a high potential (VgH) during the next light emission period.

(Light Emission Period)

Next, during the light emission period, a potential of the power source line (10) is set to a negative potential ($-V_{DD}$) and a potential of the merge line (12) is set to a high potential (VgH). A potential of the Tth control line (11) is maintained to a low potential (VgL), a potential of the scan line (13) is maintained to a low potential (VgL), and a potential of the image signal line (14) is maintained to zero potential. Due to this control, the driving transistor (Td) is turned ON, the threshold voltage detecting transistor (Tth) is turned OFF, and the first switching transistor (T1) is turned OFF. As a result, the organic EL element (OLED) emits light. Also, the potential of (−Vth) occurs to the source electrode of the organic EL element (OLED) due to the threshold voltage (Vth) detected during the threshold voltage detecting period. On the other hand, the voltage of (Vdata+Vth) occurs between the gate electrode and the source electrode of the driving transistor (Td), because the data potential (Vdata) written during the writing period is applied to the gate electrode of the organic EL element (OLED). As a result, the electric current [$Ids=(\beta/2)\times(Vdata)^2$] theoretically independent of the threshold voltage (Vth) of the driving transistor (Td) flows in the driving transistor (Td), whereby the organic EL element (OLED) emits light.

Next, the writing efficiency of the pixel circuit illustrated in FIG. 8 will be described below. First, when η2 represents the writing efficiency under the absence of the additional capacitor (Cs2), η2 can be represented by the following equation (13) according to the same sequence where the writing efficiency (η) is derived in the first embodiment (Hereinafter, the description about specific sequences is omitted and the result only is shown).

$$\eta 2=[Cs\cdot \mathrm{Coled}/(\mathrm{Coled}+Cs+CgsTd\mathrm{off})+CgdT1\mathrm{on}+CgsT2\mathrm{off}]/\mathrm{Call2} \quad (13)$$

In the equation (13), Call2 represents the total capacitance value of the capacitors connected to the gate electrode of the driving transistor (Td) during the writing period and can be represented by the following equation.

$$\mathrm{Call2}=Cs+CgdT1\mathrm{off}+CgsTth\mathrm{off}+\mathrm{CgsT2on}+CgdT2\mathrm{on}+CgsTd\mathrm{on}+CgdTd\mathrm{off} \quad (14)$$

In the equation (14), the meaning of each symbol is as below.

CgdT1off

: a capacitance between the gate electrode and the drain electrode when the first switching transistor (T1) is turned OFF CgsTthoff : a capacitance between the gate electrode and the source electrode when the threshold voltage detecting transistor (Tth) is turned OFF.

CgsT2on

: a capacitance between the gate electrode and the source electrode when the second switching transistor (T2) is turned OFF CgdT2on : a capacitance between the gate electrode and the drain electrode when the second switching transistor (T2) is turned ON.

CgsTdon

: a capacitance between the gate electrode and the source electrode when the driving transistor (Td) is turned ON.

CgdTdoff

: a capacitance between the gate electrode and the drain electrode when the driving transistor (Td) is turned OFF When η2' represents the writing efficiency under the existence of the additional capacitor (Cs2), η2' can be represented by the following equation, similar to the equation (13).

$$\eta 2'=[Cs\cdot(\mathrm{Coled}+Cs2)/(\mathrm{Coled}+Cs2+Cs+CgsTd\mathrm{off})+CgdT1\mathrm{on}+CgsT2\mathrm{off}]/\mathrm{Call2} \quad (15)$$

Here, the common terms in the equations (13) and (15) are defined as below:

$$Ct1=\mathrm{Coled}+Cs+CgsTd\mathrm{off} \quad (16)$$

$$Ct2=CgdT1\mathrm{on}+CgsT2\mathrm{off} \quad (17)$$

Further, the ratio of the writing efficiency (η2') under the existence of the additional capacitor (Cs2) to the writing efficiency (η2) under the absence of the additional capacitor (Cs2) can be represented by the following equation.

$$\eta 2'/\eta 2=[Cs\cdot(Coled+Cs2)/(Ct1+Cs2)+Ct2]/[Cs\cdot Coled/Ct1+Ct2] \quad (18)$$

$$=[Cs\cdot Coled/Ct1\cdot(1+Cs2/Coled)/(1+Cs2/Ct1)+Ct2]/[Cs\cdot Coled/Ct1+Ct2]$$

-continued $$=[(1+Cs2/Coled)/(1+Cs2/Ct1)+Ct1\cdot Ct2/Cs/Coled]/[1+Ct1\cdot Ct2/Cs/Coled]$$

In the equation (18), the following relationship exists from the definition of the equation (16).

$$Ct1=\mathrm{Coled}+Cs+CgsTd\mathrm{off}>\mathrm{Coled}$$

$$Cs2/\mathrm{Coled}>\mathrm{Cs2}/Ct1$$

Thus, in the equation (18), η2'/η2 is always equal to or higher than 1. This shows that the writing efficiency is improved by providing the additional capacitor (Cs2). The larger the additional capacitor (Cs2) becomes, the higher the writing efficiency becomes. Therefore, it is preferable that a capacitance value of the additional capacitor (Cs2) is equal to or higher than 10% of the capacitance value of Coled (more preferably, equal to or higher than 30% of the capacitance value of Coled).

Now, the writing efficiency of an actual pixel circuit can be calculated as below. For example, When Coled is set to 1.383 pF, Cs is set to 0.5 pF, Cs2 is set to 0.5 pF, CgsTdon and CgdTdon are set to 0.080 pF, CgsTdoff and CgdTdoff are set to 0.043 pF, CgsT1on, CgdT1on, CgsT2 on and CgdT2 on are set to 0.013 pF, and CgsT1off, CgdT1off, CgsT2off and CgdT2off are set to 0.005 pF for typical values, the writing efficiency (η2) under the absence of the additional capacitor (Cs2) is 0.572 from the equations (13), (14), (16) and (17).

On the other hand, the writing efficiency (η2') under the existence of the additional capacitor (Cs2) is 0.618 from the equations (14) to (17). In this example, the ratio (Δη/η2) of the change of the writing efficiency (the difference: Δη=η2'−η2) due to the additional capacitor (Cs2) to the writing efficiency (η2) under the absence of the additional capacitor (Cs2) is (0.618−0.572)/0.572≈0.08. Thus, the writing efficiency is improved about 8% by providing the additional capacitor (Cs2). Also, if the additional capacitor (Cs2) with the largest value as possible is used, the writing efficiency can be improved even more.

It has been quantitatively described that the writing efficiency is improved by providing the additional capacitor (Cs2), using several equations. However, it can be qualitatively described about the improvement of the writing efficiency.

First, the writing efficiency can be represented by the ratio of the Vgs range (ΔVgs) to the data voltage range (ΔVdata), as defined above. Therefore, to improve the writing efficiency, it is preferable that the Vgs range (ΔVgs) approaches the data voltage range (ΔVdata) as much as possible. On the other hand, when the image data is written, there exists the capacitor element which is connected in series to the storage capacitor (Cs), where the data potential (Vdata) from the image signal line (14) is written to the storage capacitor (Cs). For example, in the pixel circuit illustrated in the FIG. 8, the organic EL element capacitor (Coled) is one of the capacitor elements. In some pixel circuits, the organic EL element capacitor (Coled) may not be connected to the storage capacitor (Cs) in series, but, in these cases, of all parasitic capacitors of the driving transistor (Td), the threshold voltage detecting transistor (Tth) and the switching transistor (T1, T2), the parasitic capacitor element that is connected to the storage capacitor (Cs) in series during writing the image data has influence on the writing efficiency.

Hereinafter, it is described that the voltage V12 is applied to between the storage capacitor (Cs) and the organic EL element capacitor (Coled) in the example in which the organic EL element capacitor (Coled) and the storage capacitor (Cs) are connected in series. In this case, Vs represents the voltage occurred in the both side of the storage capacitor (Cs) and is represented by the simple equation (19) as below.

$$Vs=Coled/(Cs+Coled)\cdot V12 \quad (19)$$

The equation (19) suggests two points of view. One point of view is that if the capacitor element that is connected in series to the storage capacitor (Cs) where the data potential (Vdata) from the image signal line (14) is written, a portion of electric charges accumulated in the storage capacitor (Cs) are taken away by the capacitor element connected in series to the storage capacitor (Cs), thereby the writing efficiency decreases. The other point of view is that the voltage applied to the both side of the storage capacitor (Cs) becomes larger, in proportion to the capacitance value of the capacitor element connected in series to the storage capacitor (Cs).

Thus, to improve the writing efficiency, the additional capacitor (Cs2) provided in addition to storage capacitor (Cs) is connected in series to the storage capacitor (Cs) at least at the writing of the data potential. Further, it is preferable to select the capacitance value of the additional capacitor (Cs2) which is larger than that of the storage capacitor (Cs).

As in the first embodiment, in the case in which the capacitances of the organic EL element (OLED) are different in each pixel of red, green and blue, it is preferable to set each capacitance parameter as below in order to make the writing efficiency of each color be substantially the same. That is, when Coledr, Coledg and Coledb respectively represent the capacitance of each organic EL element (OLED) of red, green and blue, and Cs2r, Cs2g and Cs2b respectively represent the additional capacitance of red, green and blue, it is preferable that the values of Coledr+Cs2r, Coledg+Cs2g and Coledb+Cs2b are set to 80%~100% of the maximum value among these values (more preferably, 95%~100%).

Also, if the differences exist in the characteristic light emitting efficiency of each color of red, green and blue, the Vgs range (ΔVgs) in each pixel circuit can be different. Now, ηr, ηg and ηb represent the writing efficiency of each color, and ΔVgsmaxr, ΔVgsmaxg and ΔVgsmaxb represent the maximum values of the desired ΔVgs of each color. When Cs2r, Cs2g and Cs2b is set to cause the minimum value of ΔVgsmaxr/ηr, ΔVgsmaxg/ηg and ΔVgsmaxb/ηb to be equal to or higher than 90% of the maximum value of ΔVgsmaxr/ηr, ΔVgsmaxg/ηg and ΔVgsmaxb/ηb, the desired Vgs range (ΔVgs) in every color with substantially the same data voltage range (ΔVdata) can be obtained.

As described above, since the image display device according to this embodiment includes not only the first capacitor which the image data is written to, but also the second capacitor connected in series to the first capacitor during the writing period of the image data. Thus, the image data potential written to the first capacitor has sufficient influence on a potential of the first capacitor. As a result, it is possible to improve the writing efficiency of the image display device.

Fourth Embodiment

Figure 10:
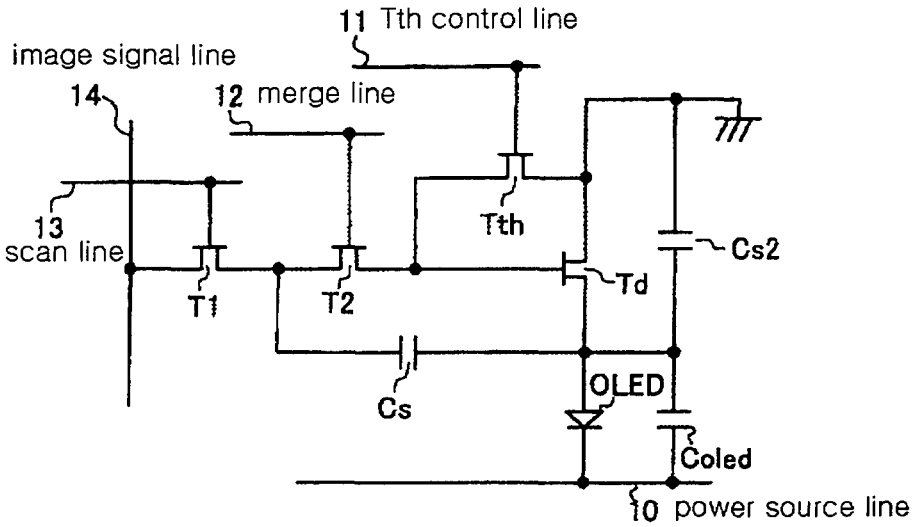
FIG. 10 is a diagram illustrating a structure of a pixel circuit corresponding to one pixel in an image display device according to a fourth embodiment of the present invention.

In the third embodiment illustrated in FIG. 8, though the additional capacitor (Cs2) is connected to the cathode electrode of the organic EL element (OLED) at one side, and to the power source line (10) at the other side, the present invention is not limited to this structure. For example, as illustrated in the FIG. 10, the additional capacitor (Cs2) can be connected to the ground line with static potential (constant potential) at the other side.

The static potential does not need to be the constant potential during all periods, i.e., the preparation period, the threshold voltage detecting period, the writing period, and the light emission period. As far as the constant potential is maintained at least from the threshold voltage detecting period to the writing period, the constant potential is included in the static potential.

Also, the constant potential does not have to mean the constant potential in the strict sense, and within the range in which the writing efficiency can be improved due to the additional capacitor (Cs2), the fluctuation of the potential may be allowed.

Figure 11:
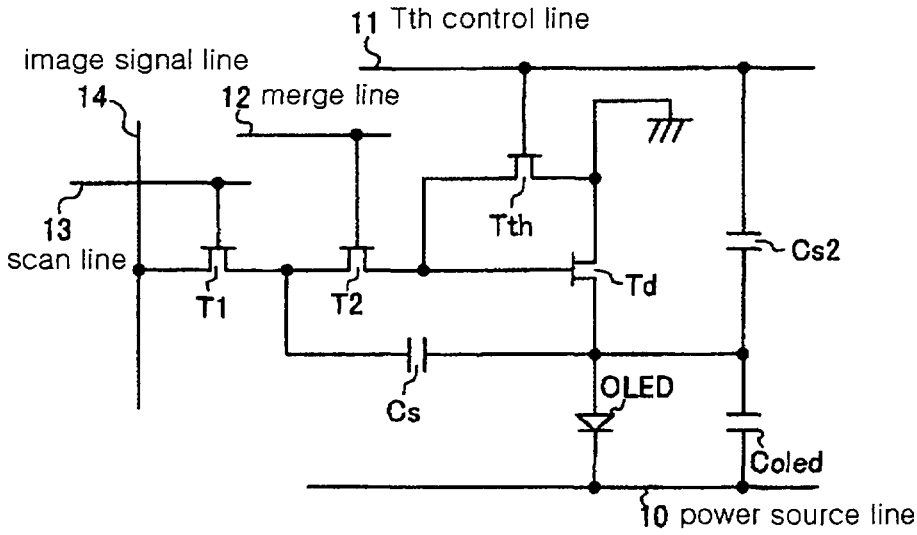
FIG. 11 is a diagram illustrating a structure of a pixel circuit which is different from the pixel circuit illustrated in the FIG. 10.
Figure 12:
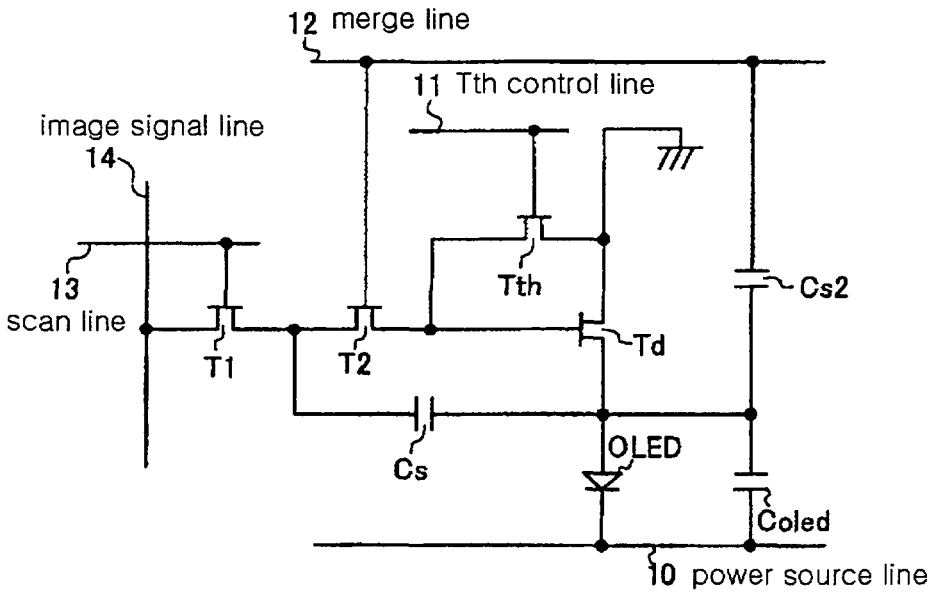
FIG. 12 is a diagram illustrating a structure of a pixel circuit which is different from the pixel circuit illustrated in the FIGS. 10 and 11.
Figure 13:
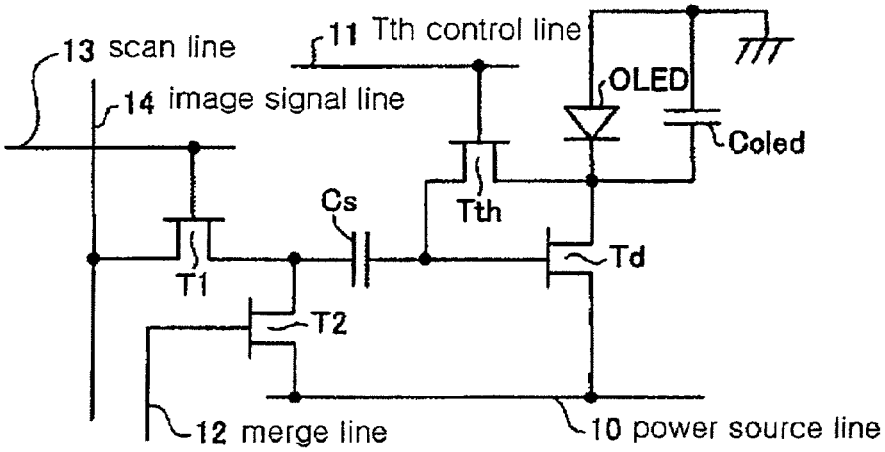
FIG.13 Prior Art
FIG. 13 is a diagram illustrating a structure of a pixel circuit corresponding to one pixel in the conventional image display device.

Further, the other side of the additional capacitor (Cs2) can be connected to the Tth control line (11) with the constant potential from the threshold voltage detecting period to the writing period (refer to FIG. 11), or the other side of the additional capacitor (Cs2) can be connected to the merge line (12) (refer to FIG. 12).

Further, in the third embodiment, the exemplary structure that the additional capacitor is applied to the pixel circuit of the structure illustrated in FIG. 8 is described. However, a pixel circuit with any connection structure may be employable as far as the pixel circuit has the driving transistor and the threshold voltage detecting transistor. The point is that it is sufficient to connect the additional capacitor which satisfies the requirements described in the third embodiment to the gate electrode of the driving transistor.

As can be seen from the foregoing, the image display device according to the present invention is useful for improving the writing efficiency in the pixel circuit. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image display device comprising:

a light emitting element emitting light when a voltage is applied thereto in a forward direction and accumulating electrical charge when a voltage is applied thereto in a reverse direction;

a driver which has a control terminal, a first terminal and a second terminal, and which controls the current flowing between the first terminal and the second terminal by the voltage between the control terminal and the first terminal, to control the light emission of the light emitting element;

a first capacitor having a first electrode and a second electrode, the first electrode being connected directly or indirectly to the control terminal of the driver, the second electrode being connected directly or indirectly to a signal line supplying the potential corresponding to an image data; and a second capacitor connected electrically in parallel to a light emitting element capacitor during a writing period, wherein a combination of the second capacitor and the light emitting element capacitor is connected electrically in series to the first capacitor during the writing period while the image data is written to the first capacitor through the signal line, wherein an electrical charge accumulated in the light emitting element and an electrical charge accumulated in the second capacitor are discharged to be supplied to the first capacitor during the writing period, wherein the second capacitor is connected to the first terminal of the driver at one side, and is connected to the second terminal of the driver at the other side, wherein the image display device further includes a switch which is arranged between the control terminal of the driver and the second capacitor, and which controls the conduction between the control terminal and the second capacitor, wherein the switch electrically connects the control terminal of the driver and the second capacitor during the writing period, and wherein the electrical charge accumulated in the second capacitor during a preparation period is supplied to the first capacitor during the writing period through the electrical connection between the control terminal of the driver and the second capacitor by the switch.

2. The image display device according to claim 1, wherein the first capacitor and the light emitting element are connected electrically in series during the writing period.

3. The image display device according to claim 1, wherein the switch electrically disconnects the control terminal of the driver and the second capacitor during a light emission period of the light emitting element.

4. The image display device according to claim 1, further comprising:

a potential line connected to the second capacitor and retaining substantially constant potential during the writing period.

5. The image display device according to claim 4, wherein the potential line is electrically connected to the first terminal or the second terminal of the driver.

6. The image display device according to claim 4, wherein the potential line is a control line to control the driving of the switch.

7. The image display device according to claim 1, wherein a capacitance value of the second capacitor is equal to or higher than 10% of the capacitance value of the light emitting element.

8. The image display device according to claim 1, further comprising a first pixel, a second pixel and a third pixel which display different colors from each other, each of the pixels having at least the light emitting element, the driver, the first capacitor and the second capacitor, wherein Csum1, Csum2 and Csum3 respectively has the value that is equal to or higher than 80% of the maximum value of the Csum1, Csum2 and Csum3, where the Csum1, Csum2 and Csum3 respectively represents the sum of the capacitance value of the second capacitor and the capacitance value of the light emitting element in the each one of the first to the third pixel.

* * * * *